US009542818B2

(12) United States Patent
Zwirn et al.

(10) Patent No.: US 9,542,818 B2
(45) Date of Patent: Jan. 10, 2017

(54) ELECTRONIC DETERRENCE DEVICES

(71) Applicant: Jeffrey D. Zwirn, Tenafly, NJ (US)

(72) Inventors: Jeffrey D. Zwirn, Tenafly, NJ (US); Charles Brodeur, Pascoag, RI (US)

(73) Assignee: Jeffrey D. Zwirn, Tenafly, NJ (US)

( * ) Notice: Subject to any disclaimer, the term of this patent is extended or adjusted under 35 U.S.C. 154(b) by 0 days.

(21) Appl. No.: 14/966,677

(22) Filed: Dec. 11, 2015

(65) Prior Publication Data

US 2016/0171844 A1 Jun. 16, 2016

Related U.S. Application Data

(60) Provisional application No. 62/090,619, filed on Dec. 11, 2014.

(51) Int. Cl.

| | |
|---|---|
| ***G08B 29/00*** | (2006.01) |
| ***G08B 5/36*** | (2006.01) |
| ***G08B 13/189*** | (2006.01) |
| ***G08B 25/08*** | (2006.01) |
| *G08B 29/02* | (2006.01) |

(52) U.S. Cl.

CPC ..... *G08B 5/36* (2013.01); *G08B 13/1895* (2013.01); *G08B 25/08* (2013.01); *G08B 29/02* (2013.01)

(58) Field of Classification Search

CPC ..... G08B 13/1895; G08B 25/08; G08B 29/02; G08B 5/36

USPC ..... 340/506; 463/47.2, 47.3, 47.4, 47.6

See application file for complete search history.

(56) References Cited

U.S. PATENT DOCUMENTS

| | | | | |
|---|---|---|---|---|
| 7,787,232 | B2 * | 8/2010 | Abatemarco | A45B 3/04 361/232 |
| 8,231,474 | B2 * | 7/2012 | Stethem | F41B 15/04 463/47.3 |
| 8,245,878 | B2 * | 8/2012 | Smith | F41H 9/10 222/3 |
| 8,277,328 | B2 * | 10/2012 | Stethem | A01K 15/02 463/47.3 |
| 8,363,376 | B2 * | 1/2013 | Abatemarco | A45B 3/04 361/232 |
| 9,257,026 | B2 * | 2/2016 | Kalina | G08B 15/00 |
| 2007/0238532 | A1 * | 10/2007 | Stethem | F41B 15/04 463/47.2 |

OTHER PUBLICATIONS

Maxwell Security Signs & Decals. RiteFlash Active LED /Decals. © 2011 Maxwel Alarm Screen Mfg., Inc. (Product Sheet).

* cited by examiner

*Primary Examiner* — Ojiako Nwugo
(74) *Attorney, Agent, or Firm* — Fish & Richardson P.C.

(57) ABSTRACT

An example electronic deterrence device includes a housing, and one or more first and second indicator lights. The one or more second indicator lights, when illuminated, illuminate a textual message visible from a front of the housing. The electronic deterrence device also includes a power supply, a switch, and a microcontroller. The microcontroller is configured to determine a position of the switch; responsive to determining that the switch is in a first position, disable the one or more first and second indicator lights; responsive to determining that the switch is in a second position, illuminate the one or more first and second indicator lights using electrical power delivered from the power supply; and responsive to determining that the switch is in a third position, illuminate the one or more first and second indicator lights using electrical power delivered from the power supply based on an ambient condition.

17 Claims, 7 Drawing Sheets

ELECTRONIC DETERRENCE DEVICES

TECHNICAL FIELD

The present disclosure relates to electronic deterrence devices.

BACKGROUND

Security systems are often used to warn users of potentially dangerous conditions. For example, a security system for a premises (e.g., a building or a piece of property) can detect security breaches at the premises (e.g., intrusions or burglaries), and warn the premises' occupants and/or a central monitoring station when security breaches have been detected. A security system can provide auditory warnings, for instance by emitting a warning sound (e.g., using a siren, horn, bell, or speaker). A security system can also provide remote warnings, for example by transmitting information about the security breach to one or more third parties (e.g., the police, security personnel, or a monitoring service). In some cases, a security system can provide a deterrent effect. For example, the presence of the security system can dissuade potential intruders from improperly entering the premises, while auditory warnings can persuade intruders to discontinue an intrusion.

SUMMARY

In general, in an aspect, an electronic deterrence device includes a housing, one or more first indicator lights visible from a front of the housing, and one or more second indicator lights. The one or more second indicator lights, when illuminated, illuminate a textual message visible from a front of the housing. The electronic deterrence device also includes a power supply, a switch having at least three positions, and a microcontroller electrically coupled to the one or more first indicator lights, the one or more second indicator lights, the power supply, and the switch. The microcontroller is configured to determine a position of the switch; responsive to determining that the switch is in a first position, disable the one or more first indicator lights and the one or more second indicator lights; responsive to determining that the switch is in a second position, illuminate the one or more first indicator lights and the one or more second indicator lights using electrical power delivered from the power supply; and responsive to determining that the switch is in a third position, illuminate the one or more first indicator lights and the one or more second indicator lights using electrical power delivered from the power supply based on an ambient condition.

Implementations of this aspect can include one or more of the following features.

In some implementations, the ambient condition can be an intensity of ambient light. The electronic deterrence device can further include a photo detector configured to determine the ambient condition based on an intensity of ambient light incident upon the photo detector.

In some implementations, the microcontroller can be configured to disable the one or more first indicator lights and the one or more second indicator lights in response to determining that the intensity of ambient light incident upon the photo detector exceeds a threshold level.

In some implementations, illuminating the one or more first indicator lights can include periodically flashing the one or more first indicator lights.

In some implementations, the microcontroller can be configured to periodically flash the one or more first indicator lights according to a user-specified time interval.

In some implementations, the electronic deterrence device can be communicatively coupled to an alarm system. The microcontroller can be configured to control the one or more first indicator lights based on information received from the alarm system.

In some implementations, illuminating the one or more first indicator lights based on information received from the alarm system can include determining, based on the information, that the alarm system is armed, and responsive to determining that the alarm system is armed, illuminating the one or more first indicator lights and the one or more second indicator lights.

In some implementations, illuminating the one or more first indicator lights based on information received from the alarm system can include determining, based on the information, that the alarm system is disarmed, and responsive to determining that the alarm system is disarmed, disabling the one or more first indicator lights.

In some implementations, the electronic deterrence device can be communicatively coupled to the alarm system through a wireless connection.

In some implementations, the wireless connection can be one of: a Wi-Fi connection, a Bluetooth connection, a Z-Wave connection, a frequency hopping spread spectrum connection, a spread spectrum connection, a Thread connection, and a Weave connection.

In some implementations, the electronic deterrence device is not communicatively coupled to an alarm system. The microcontroller can be configured to illuminate the one or more first indicator lights without receiving information from an alarm system.

In some implementations, the electronic deterrence device can further include one or more third indicator lights visible from a rear of the housing. The microcontroller can be configured to illuminate the one or more third indicator lights using electrical power delivered from the power supply when an amount of power remaining in the power supply is less than a threshold power level.

In some implementations, the electronic deterrence device can further include one or more light transmissive elements configured to transport light generated by the one or more second indicator lights to an exterior surface of the housing to illuminate the textual message.

In some implementations, the front of the housing can be configured to mount to a surface.

In some implementations, the back of the housing can be configured to mount to a surface.

In general, in another aspect, an electronic deterrence device includes a housing, one or more indicator lights, a photo detector configured to determine an intensity of ambient light incident upon the photo detector, a switch having at least three positions, and a microcontroller electrically coupled to the one or more indicator lights, the photo detector, the power supply, and the switch. The microcontroller is configured to determine a position of the switch; responsive to determining that the switch is in a first position, disable the one or more indicator lights; responsive to determining that the switch is in a second position, illuminate the one or more indicator lights and using electrical power delivered from the power supply. The microcontroller is also configured to, responsive to determining that the switch is in a third position, disable the one or more indicator lights in response to determining that the intensity of ambient light incident upon the photo detector exceeds a threshold level, and illuminate the one or more indicator lights in response to determining that the intensity of ambient light incident upon the photo detector does not exceed the threshold level.

In general, in another aspect, an electronic deterrence device includes a housing, one or more first indicator lights visible from a front of the housing, one or more second indicator lights disposed within the housing, one or more light transmissive elements configured to transport light generated by the one or more second indicator lights to an exterior surface of the housing. Each light transmissive element has a respective exterior surface having a shape of a character in a textual message. The electronic deterrence device also includes one or more third indicator lights visible from a rear of the housing, a power supply, a switch having at least three positions, and a microcontroller electrically coupled to the one or more first indicator lights, the one or more second indicator lights, the power supply, and the switch. The microcontroller is configured to determine a position of the switch; responsive to determining that the switch is in a first position, disable the one or more first indicator lights and the one or more second indicator lights; responsive to determining that the switch is in a second position, illuminate the one or more first indicator lights and the one or more second indicator lights using electrical power delivered from the power supply; and responsive to determining that the switch is in a third position, illuminate the one or more first indicator lights and the one or more second indicator lights using electrical power delivered from the power supply based on an ambient condition; and illuminate the one or more third indicator lights using electrical power delivered from the power supply when an amount of power remaining in the power supply is less than a threshold power level.

One or more of the implementations described herein can provide various benefits. For example, in some cases, implementations of the electronic deterrence device can be used to deter potential intruders from entering a premises, thereby improving the safety and security of the premises and/or its' occupants. Further, implementations of the electronic deterrence device can provide a deterrent effect, even if the premises is not equipped with an alarm system. Thus, an electronic deterrence device can improve the safety and security of the premises and/or its occupants at a relatively reduced cost. Further, implementations of the electronic deterrence device can operate in conjunction with an alarm system when an alarm system is present, and operate independently when an alarm system is not present, and thus can provide safety and security benefits under a variety of different applications.

DETAILED DESCRIPTION

Although security systems are often used to warn users of a security breach in progress (e.g., to notify users of an intruder entering the premises), it is often desirable to preemptively deter potential intruders from attempting to breach the premises, before any such breach occurs. This can be useful, for example, as a security breach will often result in property losses or injuries, or even death in certain instances, even if that breach was subsequently detected and a warning provided. Thus, deterring the breach from occurring at all would prevent that loss of property, injury, or death.

Figure 1:
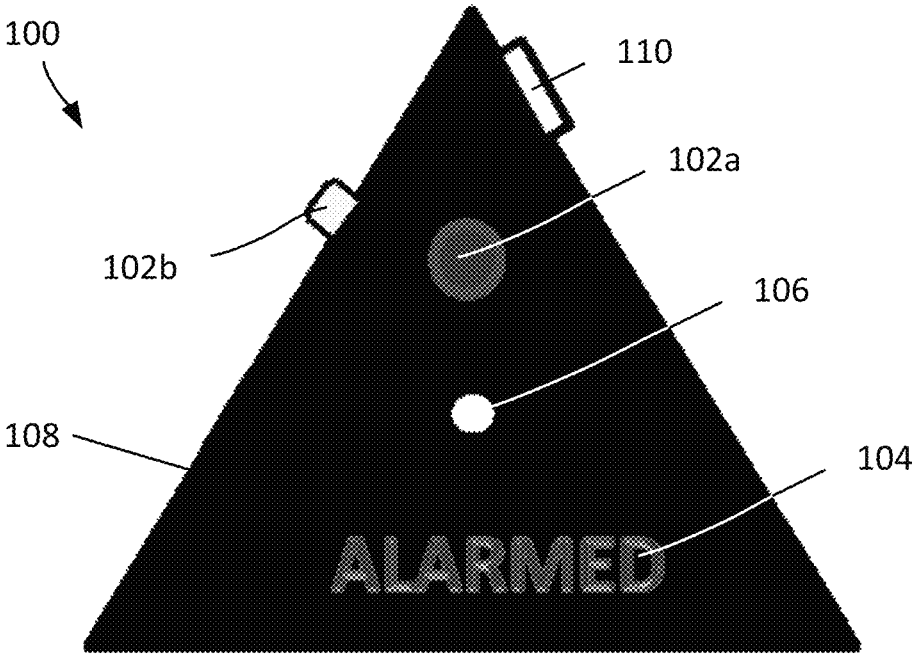
FIG. 1 is a schematic of an example electronic deterrence device.
Figures 2A, 2B, 2C, 2D:
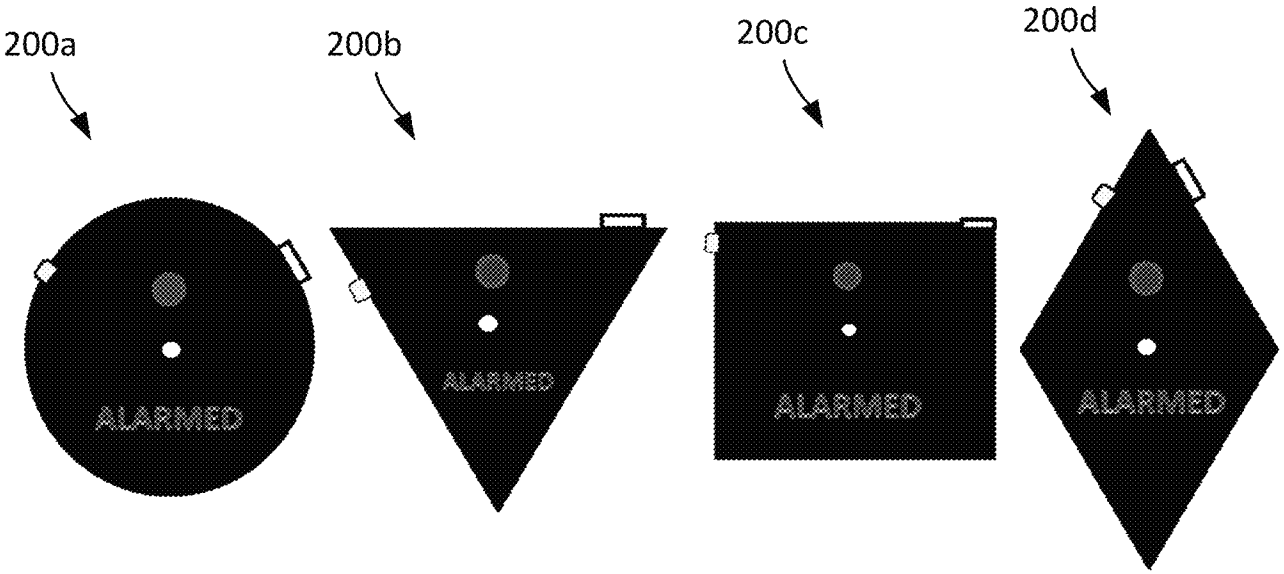
FIGS. 2A-D are schematics of example electronic deterrence devices.

In some cases, deterrence can be provided using an electronic deterrence device that provides a visual indication that a premises is protected by an alarm system, regardless of whether the premises is actually being protected by an alarm system. An example electronic deterrence device 100 is shown in FIG. 1. The electronic deterrence device 100 can be placed in one or more areas of the premises. For example, in some cases, the electronic deterrence device can be installed inside the premises (e.g., on an interior wall, an interior ceiling, or the interior side of a window or door) or outside the premises (e.g., on an exterior wall, a roof, or the exterior side of a window or door). In some cases, multiple electronic deterrence devices 100 can be positioned, either inside the premises, outside the premises, or both. As an example, the electronic deterrence device 100 can be installed on or close to the perimeter windows on the inside of a home or business. In some cases, one or more electronic deterrence devices 100 can be used in conjunction with an alarm system. In some cases, one or more electronic deterrence devices 100 can be used alone, without an alarm system being installed in the premises.

As shown in FIG. 1, the electronic deterrence device 100 includes one or more indicator lights (e.g., indicator lights 102*a-b*, as shown in FIG. 1). Indicator lights can be, for example, light emitting diodes (LEDs) or incandescent lamps. In some implementations, the indicator lights emit light from a relatively limited portion of the electronic deterrence device (e.g., from specific points along the exterior of the electronic deterrence device).

In some cases, the electronic deterrence device 100 can include one or more indicator lights positioned within the electronic deterrence device that illuminate a text and/or graphics displayed on the exterior of the electronic deterrence device. For example, one or more indicator lights can illuminate printed or stenciled text that states "Alarmed" (e.g., message 104, as shown in FIG. 1), "Warning Alarmed," or any other suitable message, image, or indicia for deterring intruders.

These messages, images, and/or indicia can be provided in a variety of ways. For example, in some cases, the housing can include one or more apertures having a physical arrangement corresponding to the message, images, or indicia (e.g., apertures in the shape of the characters of the message, or apertures in the shape of particular image). When the one or more indicator lights are illuminated, light produced by the indicator lights passes through the apertures, and illuminates the message, images, or indicia.

As another example, in some cases, the housing can include material having a pattern of light attenuating and light transmissive regions (e.g., a light transmissive film having a pattern of light transmissive ink printed upon it).

Similarly, the pattern can correspond to the message, images, or indicia (e.g., light transmissive or light attuning regions in the shape of the characters of the message, or in the shape of particular image). When the one or more indicator lights are illuminated, light produced by the indicator lights passes through the material, and illuminates the message, images, or indicia.

As yet another example, in some cases, the housing can include one or more optically transmissive elements (e.g., light tubes and light pipes) that receive light incident upon a first portion of the elements, transport some or all of the light to a second portion of the elements by internal reflection, and emit the transported light from the second portion. These elements can be shaped such that the pattern of emitted light correspond to the message, images, or indicia). For instance, a light pipe can include a first portion disposed on or near an indicator light, and a second portion directed towards the exterior of the device and having the shape of a character of a message, or the shape of a particular image. When the indicator light is illuminated, some or all of the light from the indicator light is transported by the light pipe and emitted from the exterior of the device in the pattern of the character or image. A light tube or a light pipe can be constructed, for example, using a transmissive material such as polycarbonate or acrylic plastic. In some cases, each light tube or light pipe can be surrounded by an opaque sleeve or opaque layer between its first and second portions. This can be beneficial, for example, in reducing the amount of light entering the light tube or light pipe from light sources other than the indicator light (e.g., shielding the light pipe from other surrounding indicator lights). This can be beneficial, for example, in reducing the amount of light exiting the light tube or light pipe from its middle portion.

Some or all of the indicator lights can be positioned on the electronic deterrence device 100 such that they can be readily observed. For example, the indicator light 102*a* can be positioned on the front surface of the electronic deterrence device 100 such that when the electronic deterrence device 100 is mounted with its back surface to a particular location (e.g., to a wall), the indicator light 102*a* is visible from the exterior or perimeter of the premises (e.g., away from the wall). As another example, the indicator light 102*a* can be positioned on the front surface of the electronic deterrence device 100 such that when the electronic deterrence device 100 is mounted with its front surface to a particular location (e.g., to a window), the indicator light 102*a* is visible from the exterior or perimeter of the premises (e.g., through the window). This can be beneficial, for example, as it can indicate that the premises is protected by an alarm system, even if an alarm system is not actually installed and/or activated. Thus, potential intruders may be dissuaded from attempting to enter the premises.

In some cases, one or more of the light sources can provide information to a user of the electronic deterrence device 100. For example, as shown in FIG. 1, indicator light 102*b* can act as a low battery indicator that indicates when the electronic deterrence device 100 is low in power. In some cases, the indicator light can be positioned on the electronic deterrence device 100 such that it is visible to an occupant of the premises, but is not visible to others outside the premises. For example, the indicator light 102*b* can be positioned on a side or back surface of the electronic deterrence device 100 such that when the electronic deterrence device 100 is mounted to a particular location, the indicator light 102*b* is not visible from the exterior or perimeter of the premises while remaining visible to those within the premises. This can be beneficial, for example, as it can indicate to the occupant—and not potential intruders—that the electronic deterrence device 100 is low on power. Although an example placement of indicator lights is shown in FIG. 1, this is merely an illustrative example. In practice, indicator lights can be placed at any appropriate location of the deterrence device, depending on the implementation.

Further, although example indicator lights are described above, other indicator lights are also possible, depending on the implementation. For example, in some cases, an electronic deterrence device can include several different indicator lights, each indicating respective information to an occupant and/or a potential intruder. As another example, in some cases, an electronic deterrence device can include one or more indicator lights that provide information regarding an alarm system. Example indicator lights are described in greater detail with respect to FIGS. 3A-D.

The indicator lights can be off any suitable color (e.g., red, blue, green, yellow, and so forth). In some cases, the indicators lights can be of two or more different colors (e.g., multiple differently colored LEDs). For example, in some cases, one indicator light can be of one color (e.g., red), while another LED can illuminate a message with another color (e.g., blue). As another example, in some cases, one indicator light can be of one color (e.g., blue), while another LED can illuminate a message with another color (e.g., red). In some cases, multi-color LEDs can be used, such that each LED can illuminate any one of several colors. The illumination color can be varied, for example, to indicate different types of information and/or for aesthetic purposes. Although example colors and combinations are described, these are merely illustrative examples. In practice, other colors and combinations can be used, depending on the implementation.

The indicator lights can be constantly illuminated (e.g., glowing at a constant brightness), or they can blink according to a particular intermittent pattern (e.g., blinking periodically or according to any arbitrary pattern). In some cases, multiple indicator lights can blink according to a particular pattern in combination. For example, in some cases, a first indicator light and a second indicator light can sequentially blink (e.g., one after another). As another example, in some cases, a first indicator light and a second indicator light can in blink in unison. In some cases, indicator lights can have different illumination intensities (e.g., brighter or dimmer). In some cases, the illumination behavior of the indicator lights can vary during operation of the electronic deterrence device.

The use of LEDs, in some cases, can increase the battery life of the electronic deterrence device due to their relatively low power requirements. In some cases, the LEDs can be periodically illuminated (e.g., using a blinking pattern, as described above), to reduce the amount of time that the LEDs are illuminated, which can further increase the battery life of the electronic deterrence device. In some cases, the illumination pattern of the LEDs can be specified by the user (e.g., through a pattern selection switch, or other appropriate interface), or automatically by the device.

In some cases, the electronic deterrence device can be self-contained and can operate on a battery (e.g., a dry cell power source, or other suitable power source). In some cases, the battery can be replaced. In some cases, replacement of the battery may require the removal of the device from its installed location. In some cases, the battery can be replaced without removing the device (e.g., through the use of a battery housing that can be accessed without removing the device from its installed location).

In some cases, the electronic deterrence device is not self-contained, and can require electricity from an outside source (e.g., by being hardwired to a structure's electrical system). In these cases, the electronic deterrence device can be installed at the before, after, or at the same time as the installation of other components of an alarm system. The electronic deterrence device can also be interconnected with the other components of the alarm system (e.g., communicatively coupled to a control panel of the alarm system) in order to interact with the other components of the alarm system. In some cases, the electronic deterrence device can be powered from a separate DC power source, or a DC rechargeable battery backup power supply. In some cases, multiple electronic deterrence devices can each be powered individually, or they can be interconnected and powered in series. In some cases, multiple electronic deterrence devices can be connected in a parallel wired configuration so that one power source or power supply operates all of the connected devices.

As shown in FIG. 1, in some cases, the electronic deterrence device 100 can include a photo detector 106 (e.g., a phototransistor) that can detect the presence or the absence of light and/or an intensity of light (e.g., from the ambient environment) and adjust the behavior of the electronic deterrence device 100 accordingly. In some cases, the electronic deterrence device 100 can illuminate the indicator lights only when the photo detector 106 determines that it is dark (e.g., when the photo detector does not detect any ambient light, or when the photo detector detects less than a threshold intensity of light). In some cases, the electronic deterrence device 100 can illuminate the indicator lights more intensely when it determines that it is bright (e.g., during the day), and less intensely when it determines that it is dark (e.g., during the night). This can be beneficial, for example, by reducing the overall power usage of the electronic deterrence device.

As shown in FIG. 1, the electronic deterrence device can include a housing 108 that encloses all or some of the other components of the electronic deterrence device. The housing 108 can vary in size, depending on the implementation. For example, in some cases, the housing 108 have a length and/or width of approximately less than 1 inch, 1 inch, 2 inches, 3 inches, 4 inches, 5 inches, or more. The composition of the housing 108 can also vary, depending on the implementation. For example in some cases, the housing can be made of plastic, metal, wood, glass, or any combination thereof.

As described above, the electronic deterrence device can have indicator lights that are positioned such that they can be readily observed once the electronic deterrence device has been installed. Accordingly, the electronic deterrence device can include one or more mounts that can be used to facilitate proper mounting of the device to a suitable surface (e.g., a wall or window). For example, in some cases, the housing can include an adhesive layer (e.g., double-sided adhesive film or tape) along an exterior of the housing, such that the housing can be affixed to a surface. As another example, in some cases, the electronic deterrence device can include a mounting anchor (e.g., a loop or sleeve), such that the electronic deterrence device can be supported by a peg, screw, or nail embedded in a surface. As another example, in some cases, the housing can include a protruding element (e.g., a peg, a nail, or a tooth), such that the protruding element can be driven into a surface to support the electronic deterrence device upon the surface.

For example, in some cases, the housing of the electronic deterrence device can include a mount that couples with a surface (e.g., a wall), such that when the mount is coupled with the surface, one or more particular indicator lights (e.g., the indicator light 102*a*) are facing away from the surface. As another example, in some cases, the housing of the electronic deterrence device can include a mount that couples with a surface (e.g., a window), such that when the mount is coupled with the surface, one or more particular indicator lights (e.g., the indicator light 102*a*) are facing towards the surface.

In general, the electronic deterrence device can include a control module that controls the operation of the electronic deterrence device. For example, in some cases, a control module can control the illumination behavior of the indicator lights (e.g., by selectively applying electric current to the indicator lights to achieve certain illumination patterns). In some implementations, the control module can receive information from one or more components, interpret the information, then adjust the operation of one or more components in response. For example, in some cases, the control module can receive information from the photo detector, interpret the information to determine if light is present, and in response, adjust the illumination of the indicator lights. In some implementations, the control module can receive information from a user (e.g., inputs entered by the user through a user interface, such as a button, switch, and dial), and in response, adjust the operation of one or more components of the electronic deterrence device. In some implementations, the control module can receive information from other devices (e.g., an alarm system control panel), and in response, adjust the operation of one or more components of the electronic deterrence device. Example control modules are described in greater detail with respect to FIGS. 3A-D.

In some cases, the electronic deterrence device can be programmed by a user (e.g., the occupants of a premises), the user's agent (e.g., a technician installing the electronic deterrence device), and/or the manufacturer to the electronic deterrence device. Programming the electronic deterrence device can, in some cases, alter the performance of the electronic deterrence device in different ways. For example, in some cases, programming the electronic deterrence device can cause the device to illuminate the indicator lights differently (e.g., adjusting the rate of blinking, changing the illumination from blinking to solidly glowing and vice versa, changing the conditions under which the lights are illuminated, changing the illumination intensity, changing the illumination color, and so forth). In some implementations, the electronic deterrence device can be programmed based on commands entered through a user interface, such as a button, switch, and dial. For example, in some cases, the electronic deterrence device can include one or more dual in-line package (DIP) switches that correspond to certain commands or operating parameters. For instance, DIP switches can be used to alter the illumination behavior of one or more indicator lights (e.g., switching lights on and off, changing the blink rate, specifying whether multiple lights blink in unison or sequentially, specifying the color of illumination, and so forth). Each DIP switch can correspond to an individual light, or to multiple lights. In some cases a DIP switch can also be used to control the behavior of other components, for example to switch the photo detector on or off.

In some implementations, the electronic deterrence device can be used to visually warn a potential intruder that an alarm system may be present. For example, it may indicate that the alarm system is armed, it may indicate that there is an alarm system installed in the premises, and/or it may indicate that if the intruder attempts to break in the alarm will sound and the police will be contacted (which in turn would generally result in the police responding to the emergency occurring at the premises). In some cases, the electronic deterrence device can simulate the presence of an alarm system, even if an alarm system is not present on the premises.

In some cases, the electronic deterrence device can be arranged such that, when viewed from a perspective outside of the premises (e.g., on a street), the electronic deterrence device might not be visible. However, when viewed from a perspective in closer proximity to the premises, the electronic deterrence device might be visible, depending on the surrounding ambient lighting conditions that are present both outside and/or inside the premises. This can be accomplished, for example, by positioning the electronic deterrence device in a particular location within the premises that is not readily visible from afar. This can be beneficial, for example, as it preserves the aesthetics of a premises from a distance (e.g., by hiding the electronic deterrence device), and providing deterrence when viewed from a closer distance. For example, the electronic deterrence device can be mounted to a fixed or movable piece of window glass, or positioned in other areas of the premises to identify the location as being electronically protected. Thus, potential intruders would readily understand that the premise appears to be electronically protected, even if it is not actually protected by an alarm system. As a result, the electronic deterrence device provides a deterrent effect against criminal activity.

Implementations of the electronic deterrence device described above may provide various benefits. For example, implementations of the electronic deterrence device can provide a visual deterrent to potential intruders. This can be useful, as intruders often search for a relatively easy and/or soft target and may avoid entering a home or business which visually identifies that an alarm system is present. If the intruder approaches a home or business and observes a visual warning (e.g., as provided by an electronic deterrence device), indicating that the home or business is being protected by a security system, the intruder may be deterred from carrying out an intrusion.

Further, the electronic deterrence device can provide a beneficial effect to other premises in the surrounding neighborhood. For example, in many cases, neighborhoods in which security systems are densely installed have fewer incidents of residential burglaries than the neighborhoods with fewer security systems. Thus, implementations of the electronic deterrence device can increase the perceived security system installation base of a neighborhood, and further help deter intruders from breaching any premises of a neighborhood.

Further, as implementations of the electronic deterrence device can be used independently from a security system, the electronic deterrence device can be used to provide this beneficial deterrent effect, potentially without the added cost of installing a security system.

Thus, implementations of the electronic deterrence device described herein can be used to enhance the security of a premises, and can provide a deterrent effect against intruders, either alone or in conjunction with an alarm system.

Although an example electronic deterrence device 100 is shown in FIG. 1, this is merely an illustrative example. In practice, an electronic deterrence device can be different than that shown in FIG. 1. By way of example, FIGS. 2A-D are schematics illustrating examples of electronic deterrence devices 200*a-d*, each of which has a different arrangement of a housing, indicator lights, and a photo detector. Other arrangements are also possible.

Figure 3A:
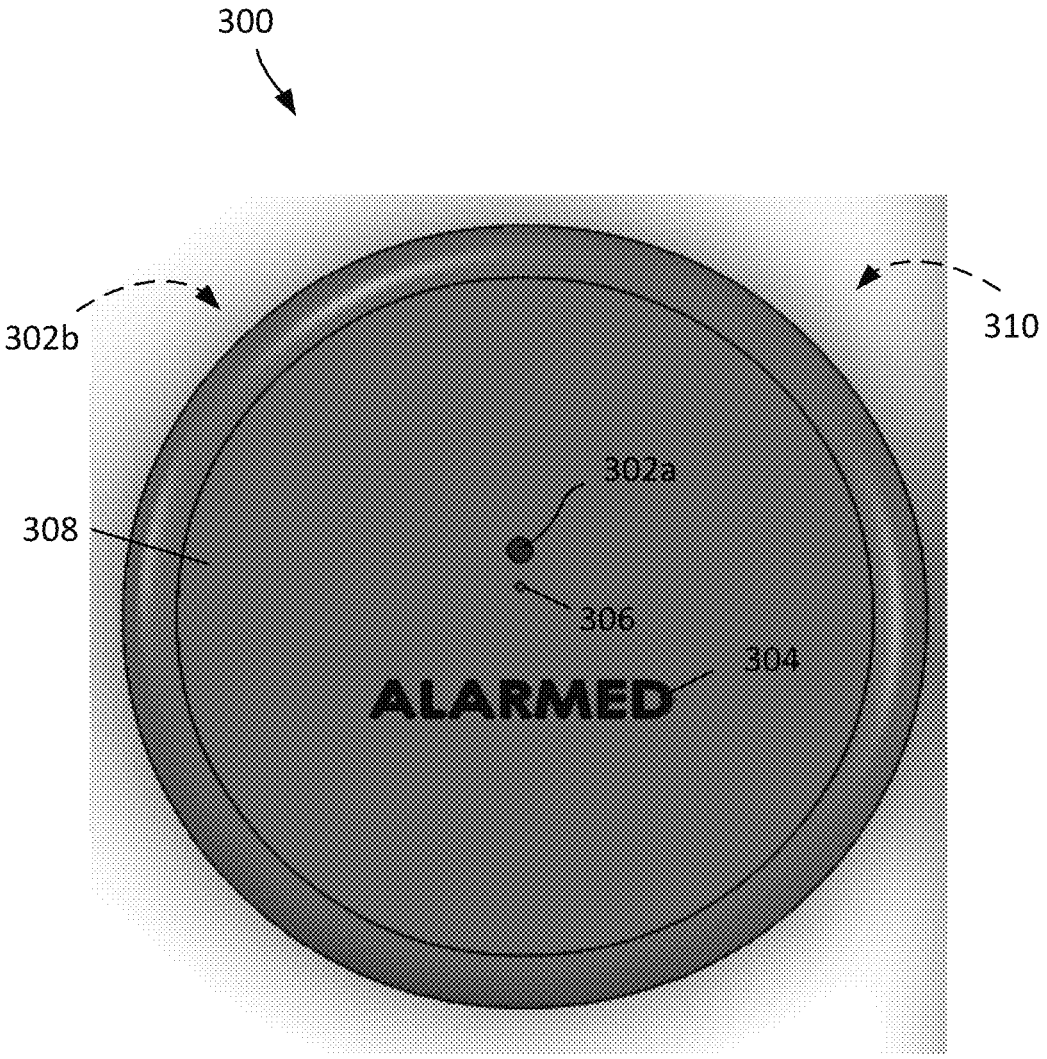
FIG. 3A is a schematic of an example electronic deterrence device.
Figure 3B:
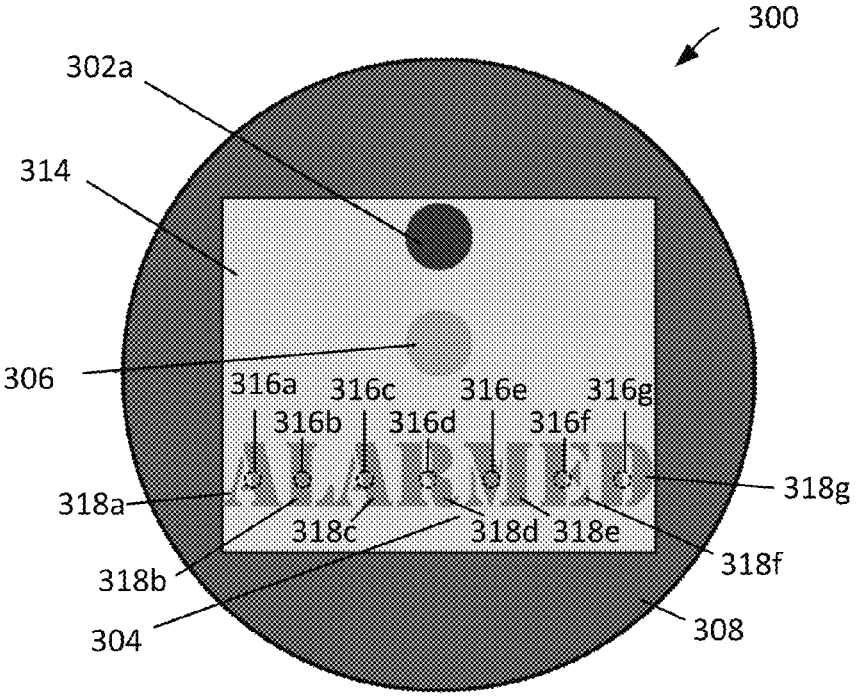
FIG. 3B is a schematic illustrating a front of an example electronic deterrence device.
Figure 3C:
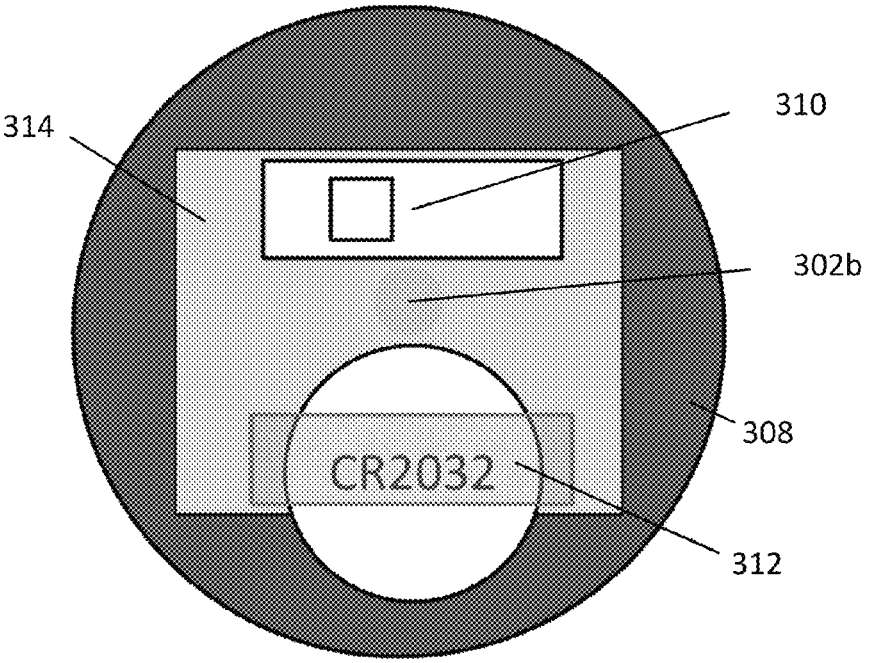
FIG. 3C is a schematic illustrating a back of an example electronic deterrence device.

Another example electronic deterrence device 300 is shown in FIG. 3A. The front and rear of the electronic deterrence device 300 are schematically shown in FIG. 3B and FIG. 3C, respectively.

In general, the electronic deterrence device 300 can be similar to those shown and described with respect to FIGS. 1 and 2A-D. For example, the electronic deterrence device 300 includes a housing 308, an indicator light 302*a* positioned along a front of the electronic deterrence device 300, and an indicator light 302*b* positioned along a rear of the electronic deterrence device 300.

Figure 4:
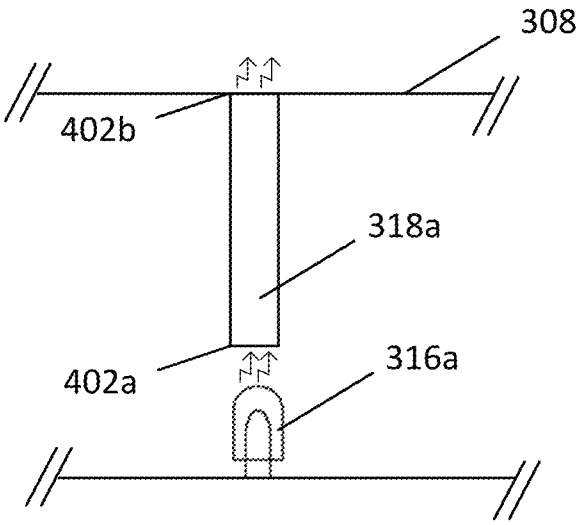
FIG. 4 is a schematic illustrating an indicator light, a light pipe, and a housing.

The electronic deterrence device 300 also includes a message 304 (e.g., "Alarmed") that is illuminated by one or more indicator lights positioned within the housing 300. In this example, the electronic deterrence device 300 includes several indicator lights 316*a-g*, each positioned beneath respective light pipe 318*a-g*. Each light pipe 318*a-g* extends from its respective indicator light to an exterior of the housing 308. As an illustrative example, FIG. 4 shows a simplified arrangement between a single indicator light 316*a*, a single light pipe 318*a*, and the housing 308. When the indicator light 316*a* is illuminated, light emitted by the indicator light 316*a* enters the light pipe 318*a* at a first end 402*a*, is transported by the light pipe 318*a* to an opposite end 402*b*, and is then emitted from the opposite end 402*b* and from the housing 308. The cross-section of the opposite end 402*b* has the shape of a character of the message 304 (e.g., "A," as shown in FIG. 3B), and thus emits light in a pattern of the character. In some cases, the light pipe 318*a* can be surrounded by an opaque sleeve or opaque layer between ends 402*a-b* (e.g., on the sides of the light pipe 318*a*). This can be beneficial, for example, in reducing the amount of light entering the light pipe 318*a* from light sources other than the indicator light 316*a* (e.g., shielding the light pipe from other surrounding indicator lights). This can also be beneficial, for example, in reducing the amount of light exiting the light pipe 318*a* between the ends 402*a-b*.

Similarly, each of the other characters of the message 304 can be illuminated by a respective indicator light 316*b-g* and light pipe 318*b-g*. Likewise, each light pipe 318*b-g* can be surrounded by an opaque sleeve or an opaque layer.

For illustrative purposes, the indicator lights 316*a-g* are depicted in FIG. 3B as being directly visible from the exterior of the device; in practice, however, the indicator lights 316*a-g* are contained within the housing 308, and in some cases, are only visible through the light pipes 318*a-g*. Further, although a separate indicator light and light pipe can be used to illuminate each individual character, in some cases, a single indicator light and light pipe can be used to illuminate several characters or several different portions of an image at once. Further still, in some cases, multiple indicator lights and light pipes can be used to illuminate a single character or a single portion of an image (e.g., to illuminate a character or portion of an image more brightly). Further still, in some cases, multiple indicator lights and light pipes can be used to collectively illuminate multiple characters or portions of an image. Further still, in some cases, in some cases, multiple indicator lights and a single light pipe can be used to collectively illuminate multiple characters or portions of an image.

The electronic deterrence device 300 also includes a photo detector 306 to detect ambient light, and a switch 310 to control the operation of the electronic deterrence device 300. In this example, the electronic deterrence device 300 also includes a battery 312 (e.g., a button cell battery, such as a CR2032 battery, as shown in FIG. 3C) to power the components of the electronic deterrence device 300.

In a similar manner as described with respect to FIGS. 1 and 2A-D, the electronic deterrence device 300 can be used to indicate that a premises is protected by an alarm system, even if an alarm system is not actually installed and/or activated. Thus, potential intruders may be dissuaded from attempting to enter the premises.

Figure 3D:
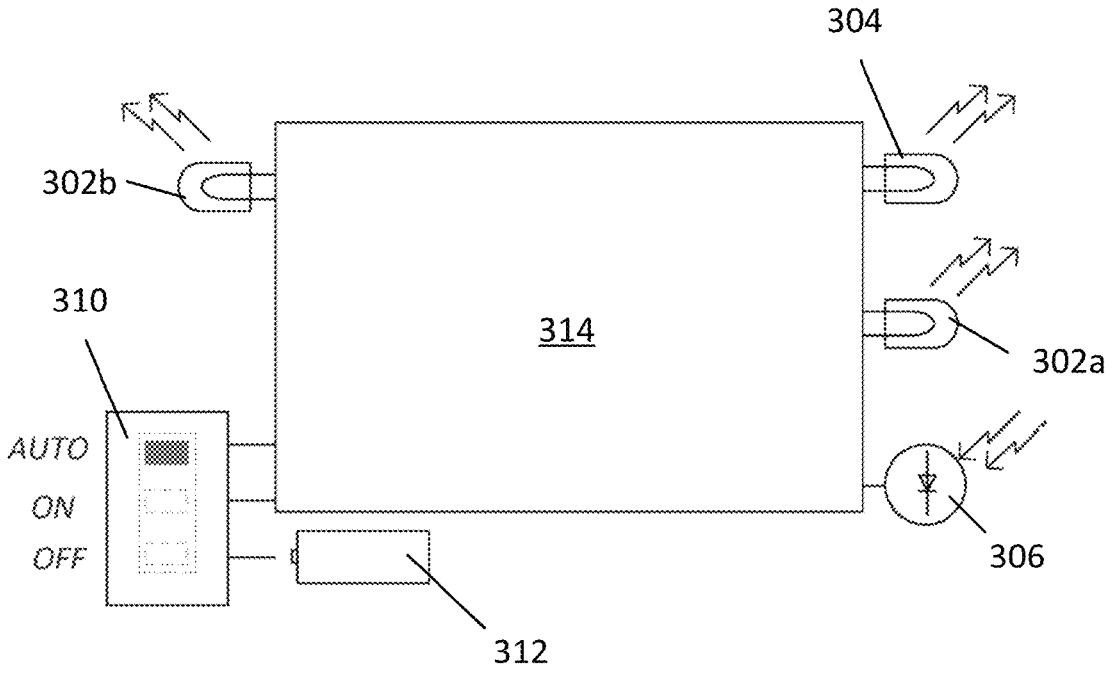
FIG. 3D is a schematic illustrating example components of an electronic deterrence device.

As shown in FIGS. 3B and 3C, the electronic deterrence device 300 also includes a control module 314 that controls the operation of the components of the electronic deterrence device 300. For illustrative purposes, the control module 314 and battery 312 are depicted as being visible from the exterior of the device; in practice, however, these components are contained within the housing 308, and are not visible from the exterior of the device. The arrangement of the control module 314 with respect to the other components of the electronic deterrence device 300 is shown schematically in FIG. 3D. As shown in FIG. 3D, the control module 314 is electrically coupled to the indicator lights 302*a-b* and 304, photo detector 306, switch 310, and battery 312, such that it can send electrical signals and/or receive electrical signals from each of the components. The control module 314 can be any controller capable of receiving, sending, and processing electrical signals. For example, in some cases, the control module 314 can be a microcontroller, such as a PIC12LF1571 microcontroller (Microchip Technology, Inc., Hauppauge, N.Y.).

In some cases, the control module 314 can control the components of the electronic deterrence device 300 based on the position of the switch 310. For example, the switch 310 can have three possible positions: "off," "on," and "auto," each corresponding to a different operational mode. The user can manipulate the switch 310 to select one of these modes.

When the switch 310 is in the "off" position, the control module 314 can disable some or all of the electronic deterrence device 300. For example, the control module 314 can disable the indicator lights 302*a-b* and 304, and the photo detector 306, such that none of these components draw a substantial amount of battery power. In some cases, the control module 314 itself can also be disabled.

When the switch 310 is in the "on" position, the control module 314 can supply electrical power from the battery 312 to the indicator lights 302*a* and 304 such that they flash continuously (e.g., once every 1 second, 5 seconds, 10 seconds, 15 seconds, or any other interval of time). In some cases, the control module 314 can supply electrical power from the battery 312 to the indicator lights 302*a* and 304 such that they are continuously illuminated (instead of flashing continuously). This mode of operation can be useful, for example, if the user wishes that the electronic deterrence device 300 continuously indicate the presence of an alarm system. As the indicator lights 302*a* and 304 are continuously flashing or continuously illuminated in this mode, the control module 314 can also disable the photo detector 306 (e.g., to conserve battery power), or otherwise ignore any measurements or signal obtained by the photo detector 306. In this mode, the control module 314 can also monitor the amount of battery power remaining in the battery 312 (e.g., by measuring a voltage across the battery 312), and flashing the indicator light 302*b* when the battery power has dropped below a threshold value (e.g., below a threshold voltage, such as 2.7 V for a CR2032 battery).

When the switch 310 is in the "auto" position, the control module 314 can supply electrical power from the battery 312 to the indicator lights 302*a* and 304 only when the photo detector 306 detects less than a threshold intensity of ambient light. The threshold intensity of light can be, for example, an empirically determined value. For example, in some cases, the threshold intensity of light can be set to differentiate between night time and day time, a room being illuminated and not illuminated, or other such conditions. This mode of operation can be useful, for example, if the user wishes that the electronic deterrence device 300 indicate the presence of an alarm system when the premises is relatively dark, but not when the premises is relatively light (e.g., to save battery power).

In some cases, the threshold intensity of light can be empirically determined by a manufacturer of the electronic deterrence device 300. For example, a manufacturer can test the electronic deterrence device 300 under a variety of lighting conditions, and identify a threshold intensity of light that can be used to differentiate between night time and day time, a room being illuminated and not illuminated, or other such conditions. In some cases, the threshold intensity of light can be empirically determined by a user of the electronic deterrence device 300. For example, a user can similarly test the electronic deterrence device 300 under a variety of lighting conditions, and identify a threshold intensity of light that can be used to differentiate between various conditions. In some cases, the user can set the threshold intensity of light according to his particular preference.

As with the "on" mode, in the "auto" mode, the control module 314 can also monitor the amount of battery power remaining in the battery 312 (e.g., by measuring a voltage across the battery 312), and flashing the indicator light 302*b* when the battery power has dropped below a threshold value (e.g., below a threshold voltage, such as 2.7 V for a CR2032 battery).

In some cases, the control module 314 can determine the amount of battery power remaining in the battery 312 according to a periodic cycle. For example, in some cases, the control module 314 can obtain a measurement one every 1 second, 5 seconds, 10 seconds, or any other period of time. Similarly, the control module 314 can also obtain measurements from the photo detector 306 according to a periodic cycle. For example, in some cases, the control module 314 can obtain a measurement one every 1 second, 5 seconds, 10 seconds, or any other period of time. In some cases, the control module 314 can obtain measurements regarding the battery 312 and the photo detector 306 according to a single synchronized cycle. In some cases, the control module 314 can obtain measurements regarding the battery 312 and the photo detector 306 according to a different cycles.

In some cases, the behavior of the control module 314 can be altered by a user (e.g., the occupants of a premises), the user's agent (e.g., a technician installing the electronic deterrence device), and/or the manufacturer to the electronic deterrence device. For example, the flash intervals of each indicator light, the threshold battery level, the battery measurement interval, the photo detector measurement interval, and/or any other parameter of the control module 314 can be stored by the control module 314, and one or more of these parameters can be modified. Parameters can be modified, for example, using a suitable input device (e.g., a keypad, switch, dial, knob, touch sensitive surface, or other device) and/or by an external device (e.g., a separate computer system, smartphone, tablet computer, and/or other device) through an appropriate interface (e.g., a hard-wired connection port or a wireless interface). As an example, the electronic deterrence device can include a hard-wired connection port that communicatively couples the device to a computer system via a communications cable, and the computer system can transmit information (e.g., firmware updates or commands) to modify the programming of the control module 314 to change its behavior.

Figure 5:
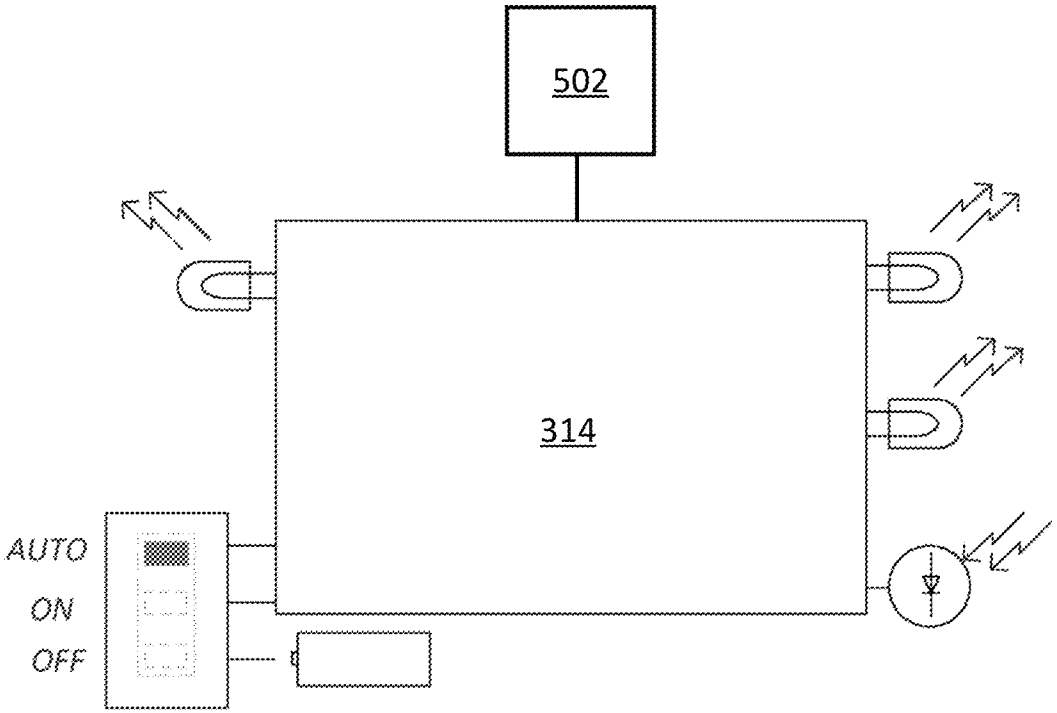
FIG. 5 is a schematic illustrating example components of an electronic deterrence device.

In some cases, the control module 314 can be communicatively coupled to the control panel of an alarm system. For instance, an alarm system can include a centralized control panel that allows a user to access settings associated with the alarm system, arm and disarm the alarm system, and/or modify the operational parameters of the alarm system (e.g., enable or disable various components of the alarm system and/or enable or disable protected "zones" of a premises). The control module 314 can be communicatively coupled to the centralized control panel, and can modify the behavior of the electronic deterrence system 300 based on the status of the alarm system. The control module 314 can communicate with the centralized control panel through a hard-wired connection, or through a wireless connection (e.g., a connection made via Wi-Fi, Bluetooth, Z-Wave, Thread protocol, Weave protocol, frequency hopping spread spectrum, spread spectrum, ZigBee or any other connection). The control module can receive information, for instance, using a wireless transceiver 502 communicatively coupled to the control module 314 (e.g., as shown in FIG. 5), using a communications protocol appropriate for the connection medium.

As an example, when the alarm system is armed (e.g., when the alarm is monitoring the premises for security breaches), the control module 314 can communicate with the control panel of the alarm system, determine that the alarm system is armed, and illuminate one or more indicator lights in response (e.g., by flashing indicator lights 302*a* and/or 302*b* according to a first frequency) and or illuminate one or more indicator lights in a particular manner (e.g., a particular color).

As another example, when the alarm system has been triggered (e.g., when the alarm has detected a security breach and has not yet been disarmed, often referred to as an "alarm memory" state), the control module 314 can communicate with the control panel of the alarm system, determine that the alarm system has been triggered, and illuminate one or more indicator lights in response (e.g., by flashing indicator lights 302*a* and/or 302*b* according to a second faster frequency), and or illuminate one or more indicator lights in a particular manner (e.g., a different particular color). This can be useful, for example, as it informs a user that the alarm has been previously triggered, and that a potential dangerous situation may exist inside the premises. Thus, the user is made more aware of the risks, and can call others for assistance (e.g., the police, a security provider, or any other responder).

As another example, when the alarm system is disarmed (e.g., when the alarm is not monitoring the premises for security breaches), the control module 314 can communicate with the control panel of the alarm system, determine that the alarm system is disarmed, and deactivate one or more indicator lights in response.

Thus, the control module 314 can selectively illuminate and/or disable one or more indicator lights to provide information regarding the status of the alarm system. However, when the control module 314 is not in communication with the control panel of the alarm system (e.g., when there is no alarm system on the premises), the control module 314 can illuminate one or more indicator lights as described above. In this manner, the electronic deterrence device can work in unison with an alarm system when an alarm system is present, and operate independently when an alarm system is not present.

Some implementations of the subject matter and operations described in this specification can be implemented in digital electronic circuitry, or in computer software, firmware, or hardware, including the structures disclosed in this specification and their structural equivalents, or in combinations of one or more of them. For example, in some implementations, the control module can be implemented using digital electronic circuitry, or in computer software, firmware, or hardware, or in combinations of one or more of them.

Some implementations described in this specification can be implemented as one or more groups or modules of digital electronic circuitry, computer software, firmware, or hardware, or in combinations of one or more of them. Although different modules can be used, each module need not be distinct, and multiple modules can be implemented on the same digital electronic circuitry, computer software, firmware, or hardware, or combination thereof.

Some implementations described in this specification can be implemented as one or more computer programs, i.e., one or more modules of computer program instructions, encoded on computer storage medium for execution by, or to control the operation of, data processing apparatus. A computer storage medium can be, or can be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Some of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and processors of any kind of digital computer. Generally, a processor will receive instructions and data from a read only memory or a random access memory or both. A computer includes a processor for performing actions in accordance with instructions and one or more memory devices for storing instructions and data. A computer may also include, or be operatively coupled to receive data from or transfer data to, or both, one or more mass storage devices for storing data, e.g., magnetic, magneto optical disks, or optical disks. However, a computer need not have such devices. Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD ROM and DVD-ROM disks. The processor and the memory can be supplemented by, or incorporated in, special purpose logic circuitry.

A number of embodiments have been described. Nevertheless, it will be understood that various modifications may be made without departing from the spirit and scope of the disclosure. Accordingly, other implementations are within the scope of the following claims.

What is claimed is:

1. An electronic deterrence device comprising:

a housing;

one or more first indicator lights visible from a front of the housing;

one or more second indicator lights, wherein the one or more second indicator lights, when illuminated, illuminate a textual message visible from the front of the housing;

a power supply;

a switch having at least three positions; and a microcontroller electrically coupled to the one or more first indicator lights, the one or more second indicator lights, the power supply, and the switch, wherein the microcontroller is configured to:

determine a position of the switch;

responsive to determining that the switch is in a first position, disable the one or more first indicator lights and the one or more second indicator lights;

responsive to determining that the switch is in a second position, illuminate the one or more first indicator lights and the one or more second indicator lights using electrical power delivered from the power supply; and responsive to determining that the switch is in a third position, illuminate the one or more first indicator lights and the one or more second indicator lights using electrical power delivered from the power supply based on an ambient condition.

2. The electronic deterrence device of claim 1, wherein the ambient condition is an intensity of ambient light, and wherein the electronic deterrence device further comprises a photo detector configured to determine the ambient condition based on an intensity of ambient light incident upon the photo detector.

3. The electronic deterrence device of claim 2, wherein the microcontroller is configured to disable the one or more first indicator lights and the one or more second indicator lights in response to determining that the intensity of ambient light incident upon the photo detector exceeds a threshold level.

4. The electronic deterrence device of claim 1, wherein illuminating the one or more first indicator lights comprises periodically flashing the one or more first indicator lights.

5. The electronic deterrence device of claim 4, wherein the microcontroller is configured to periodically flash the one or more first indicator lights according to a user-specified time interval.

6. The electronic deterrence device of claim 1, wherein the electronic deterrence device is communicatively coupled to an alarm system, and wherein the microcontroller is configured to control the one or more first indicator lights based on information received from the alarm system.

7. The electronic deterrence device of claim 6, wherein controlling the one or more first indicator lights based on information received from the alarm system comprises:

determining, based on the information, that the alarm system is armed, and responsive to determining that the alarm system is armed, illuminating the one or more first indicator lights.

8. The electronic deterrence device of claim 6, wherein controlling the one or more first indicator lights based on information received from the alarm system comprises:

determining, based on the information, that the alarm system is disarmed, and responsive to determining that the alarm system is disarmed, disabling the one or more first indicator lights.

9. The electronic deterrence device of claim 6, wherein the electronic deterrence device is communicatively coupled to the alarm system through a wireless connection.

10. The electronic deterrence device of claim 9, wherein the wireless connection is one of: a Wi-Fi connection, a Bluetooth connection, a Z-Wave connection, a frequency hopping spread spectrum connection, a spread spectrum connection, a Thread connection, or a Weave connection.

11. The electronic deterrence device of claim 1, wherein the electronic deterrence device is not communicatively coupled to an alarm system, and wherein the microcontroller is configured to illuminate the one or more first indicator lights without receiving information from an alarm system.

12. The electronic deterrence device of claim 1, wherein the electronic deterrence device further comprises one or more third indicator lights visible from a rear of the housing, and wherein the microcontroller is configured to illuminate the one or more third indicator lights using electrical power delivered from the power supply when an amount of power remaining in the power supply is less than a threshold power level.

13. The electronic deterrence device of claim 1, wherein the electronic deterrence device further comprises one or more light transmissive elements configured to transport light generated by the one or more second indicator lights to an exterior surface of the housing to illuminate the textual message.

14. The electronic deterrence device of claim 1, wherein the front of the housing is configured to mount to a surface.

15. The electronic deterrence device of claim 1, wherein the back of the housing is configured to mount to a surface.

16. The electronic deterrence device of claim 1, further comprising:

a photo detector configured to determine an intensity of ambient light incident upon the photo detector, wherein the microcontroller is electrically coupled to the photo detector, and wherein the microcontroller is further configured to:

responsive to determining that the switch is in the third position:

disable the one or more first indicator lights and the one or more second indicator lights in response to determining that the intensity of ambient light incident upon the photo detector exceeds a threshold level, and illuminate the one or more first indicator lights and the one or more second indicator lights in response to determining that the intensity of ambient light incident upon the photo detector does not exceed the threshold level.

17. The electronic deterrence device of claim 1, wherein the one or more second indicator lights are disposed within the housing;

wherein the electronic deterrence devices further comprises:

one or more light transmissive elements configured to transport light generated by the one or more second indicator lights to an exterior surface of the housing, wherein each light transmissive element has a respective exterior surface having a shape of a character in the textual message; and one or more third indicator lights visible from a rear of the housing;

wherein the microcontroller is electrically coupled to the one or more third indicator lights, and wherein the microcontroller is further configured to:

illuminate the one or more third indicator lights using electrical power delivered from the power supply when an amount of power remaining in the power supply is less than a threshold power level.

* * * * *